US008585458B2

(12) United States Patent
Armanino

(10) Patent No.: US 8,585,458 B2
(45) Date of Patent: Nov. 19, 2013

(54) NATURAL SUPPORT GARMENT

(76) Inventor: Susan Hauser Armanino, Tarzana, CA (US)

( * ) Notice: Subject to any disclaimer, the term of this patent is extended or adjusted under 35 U.S.C. 154(b) by 304 days.

(21) Appl. No.: 13/211,232

(22) Filed: Aug. 16, 2011

(65) Prior Publication Data

US 2013/0045661 A1 Feb. 21, 2013

(51) Int. Cl.
*A41C 3/00* (2006.01)

(52) U.S. Cl.
USPC ..... 450/31; 450/30; 450/33

(58) Field of Classification Search
USPC ..... 450/7–11, 14–17, 26, 28, 30–33, 36, 450/60, 61; 2/67, 69, 105, 106, 104
See application file for complete search history.

(56) References Cited

U.S. PATENT DOCUMENTS

| | | | | | |
|---|---|---|---|---|---|
| 3,628,539 | A | | 12/1971 | Fredricks | |
| 3,771,172 | A | * | 11/1973 | Barg | 2/67 |
| 4,398,538 | A | * | 8/1983 | Johnson | 450/8 |
| 4,440,174 | A | * | 4/1984 | Cordova | 450/31 |
| 4,564,015 | A | * | 1/1986 | Friedman | 450/31 |
| 4,571,742 | A | * | 2/1986 | Wior | 2/67 |
| 4,916,755 | A | * | 4/1990 | Feigenbaum et al. | 2/67 |
| 4,956,878 | A | * | 9/1990 | Boynton | 2/67 |
| 5,119,511 | A | * | 6/1992 | Packer et al. | 2/67 |
| 5,678,246 | A | * | 10/1997 | Cooley et al. | 2/67 |
| 5,797,786 | A | | 8/1998 | Smith et al. | |
| 5,944,579 | A | | 8/1999 | Fleischman | |
| 5,996,120 | A | * | 12/1999 | Balit | 2/67 |
| 6,443,805 | B1 | | 9/2002 | Kirkwood | |
| 6,516,804 | B1 | | 2/2003 | Hoffman | |
| 6,886,367 | B2 | | 5/2005 | Mitchell et al. | |
| 7,083,494 | B2 | * | 8/2006 | Sandroussi et al. | 450/31 |
| 7,186,163 | B2 | | 3/2007 | Carlucci | |
| 7,415,734 | B2 | | 8/2008 | Donnelly | |
| 7,491,113 | B2 | | 2/2009 | Bowler | |
| 7,549,908 | B2 | | 6/2009 | Yudkoff | |
| 7,814,569 | B2 | * | 10/2010 | Di Lorenzo | 2/67 |
| 2009/0324665 | A1 | | 12/2009 | Taghdiri | |
| 2011/0021113 | A1 | | 1/2011 | Hilfman | |

FOREIGN PATENT DOCUMENTS

| | | |
|---|---|---|
| WO | WO2009132096 | 10/2009 |

* cited by examiner

*Primary Examiner* — Gloria Hale
(74) *Attorney, Agent, or Firm* — Musick Peeler LLP; Reid Dammann

(57) ABSTRACT

A breast support garment is provided. The breast support garment is comprised of an outer garment structure in combination with an internal breast support structure comprising an outer garment layer. A breast support housing including adjacent first and second upper contoured support panels and first and second lower contoured support panels, the panels having exterior and interior support panels. A support attachment connecting both first and second exterior upper and lower support panels and connecting a first and second interior upper and lower support panels. A connection support attachment, the connection support attachment connects the front portion outer garment layer and the first and second exterior and interior first and second lower contoured support panels of the breast support housing. An internal support layer, the internal support layer interior to the outer garment layer and breast support housing. An internal support band connected to the internal support.

15 Claims, 8 Drawing Sheets

NATURAL SUPPORT GARMENT

BACKGROUND

1) Field of the Invention

The present invention generally relates to a breast support garment. More particularly, the invention involves a breast support garment for providing natural structure and comfort for breasts.

2) Discussion of the Related Art

A Bra is an undergarment used to cover, support, and elevate the breasts, and usually consists of two cups, typically reinforced by underwire made of metal. A bra is typically made of a fabric, such as cotton or polyester and is usually fastened with a hook fastener, typically at the back. However, bras are known for causing a variety of issues.

A poorly fitting bra can cause breast pain in some women and skin irritation, which can include chaffing, rash, and fungal infections. The fit can also cause migraines, upper shoulder, neck and back pain, due in part, to pressure supplied by the straps, which if untreated, can lead to deteriorating posture. Of course, strapless bras put all the weight of the breasts onto the chest band causing extra strain onto the rib cage and back.

Women with large breasts have no choice. Many experience upper back, shoulder, and neck pain no matter what size or style bra they wear, leading some to seek breast reduction surgery. However, an increasing number of women are switching to undershirts, jogging bras, or nothing at all.

Studies have been published illustrating that women can reduce back pain by going braless; however, going braless results in issues as well. Women will experience swinging and swaying of the breasts when walking or running. Excess moisture buildup between and under the breasts may result. Going braless can cause chafing, rashes, and/or irritation. Not to mention, going braless reveals publicly that one is not wearing a bra and may cause self-consciousness and embarrassment to the woman. Given the above problems, women need an alternative.

BRIEF DESCRIPTION OF THE DRAWINGS

The invention is described by way of example with reference to the accompanying drawings wherein.

DETAILED DESCRIPTION

Terms concerning attachments, coupling and the like, such as "connected" and "interconnected," refer to a relationship wherein structures, portions, layers, and/or panels are secured or attached to one another either directly or indirectly through intervening structures or adhesives, unless expressly described otherwise.

Figure 1:
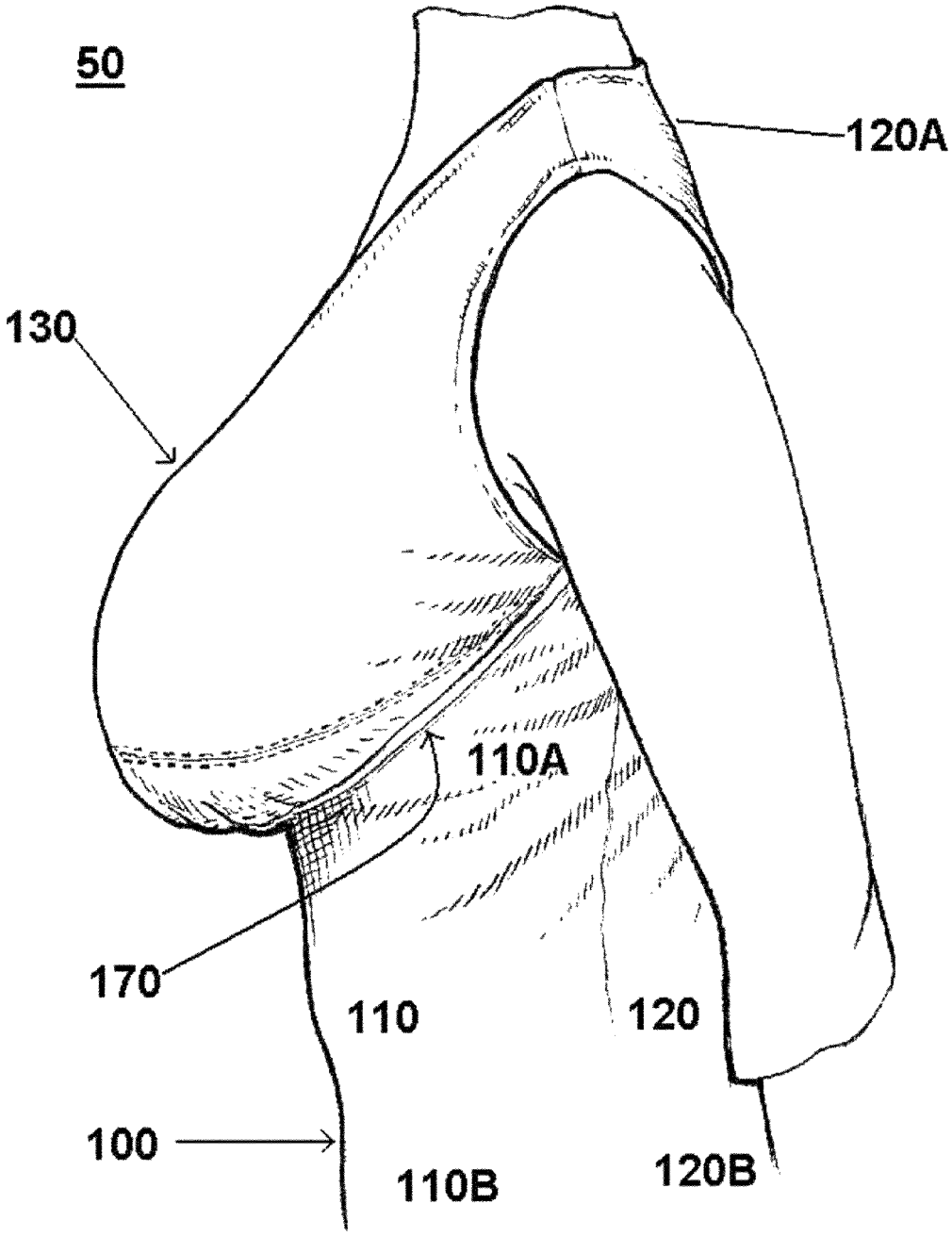
FIG. 1 illustrates an outer side perspective of the breast support garment.

FIG. 1 illustrates a Breast Support Garment 50. The Breast Support Garment 50 is comprised of an Outer Garment Layer ("OGL") 100, a Breast Support Housing 130, a Connection Support Attachment ("CSA") 170, an Internal Support Band ("ISB")(illustrated in FIG. 5) 180, and an Internal Support Layer ("ISL") 190 (illustrated in FIG. 6).

The OGL 100 is comprised of a Front Portion Outer Garment Layer 110 ("FPOG") and a Rear Portion Outer Garment Layer 120 ("RPOGL"). The Front Portion Outer Garment Layer 110 ("FPOGL") and Rear Portion Outer Garment Layer 120 (RPOGL") both have a Top and Bottom End, 110A and 110B, and 120A and 120B, respectively.

The Outer Garment Layer 100, as well as the remainder of the Breast Support Garment 50, can be comprised of any type of fabric, cloth or textile, and include chemical processes or treatments to change characteristics such as starching or using finishing agents for wrinkle-free or stain-free capability. Further, the Outer Garment Layer 100 can be made in various strengths and degrees of durability and stretching ability depending on the environment and the context in which a user wishes to wear the garment. The length can also vary to cover any part of the abdomen and lower hip area. Moreover, additional panels and layers could be added on. Specifically, the Breast Support Garment 50 can include long sleeves or other stylistic features that do not depart from the spirit of the invention.

Figure 2:
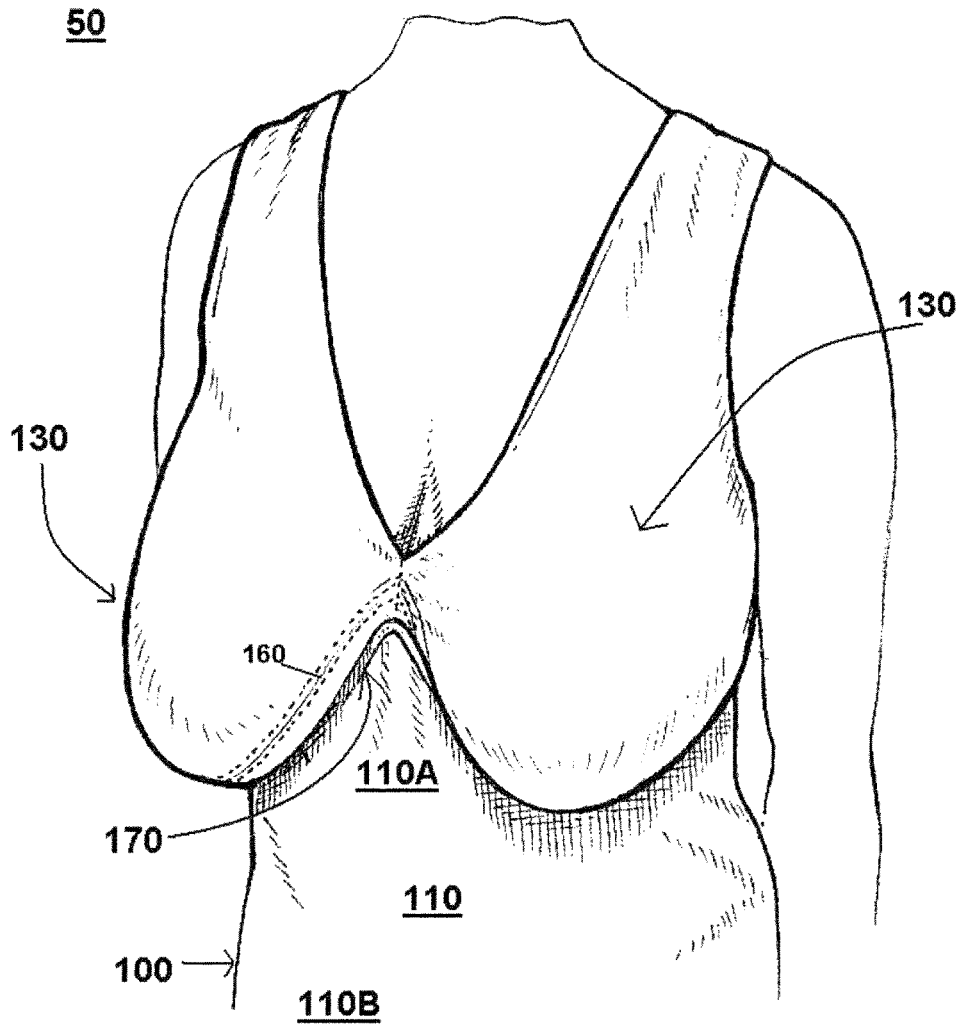
FIG. 2 illustrates a front perspective of the breast support garment.
Figure 3:
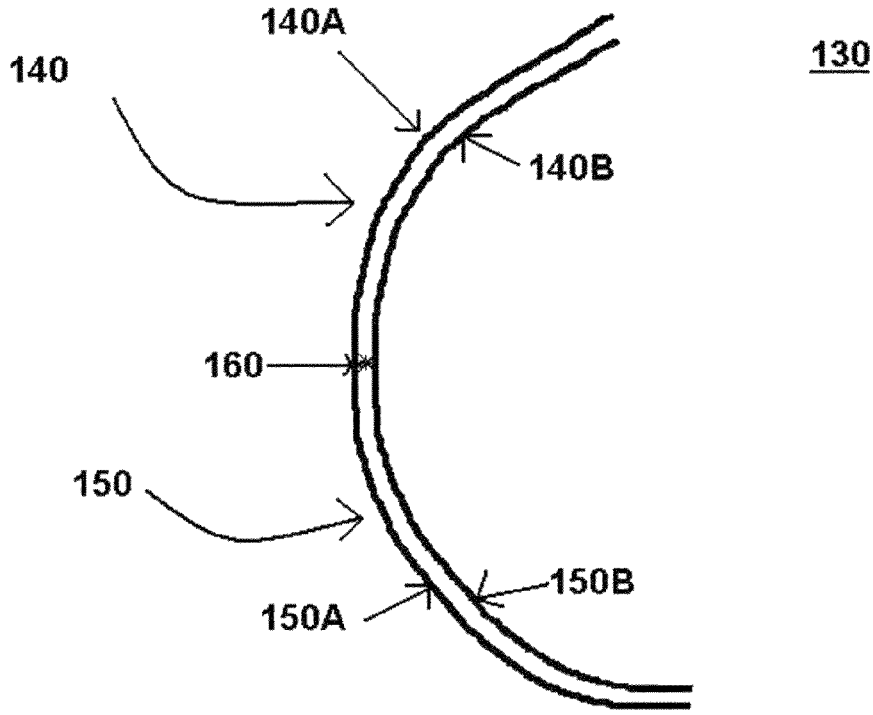
FIG. 3 illustrates a cross-sectional perspective of the breast support garment.
Figure 4:
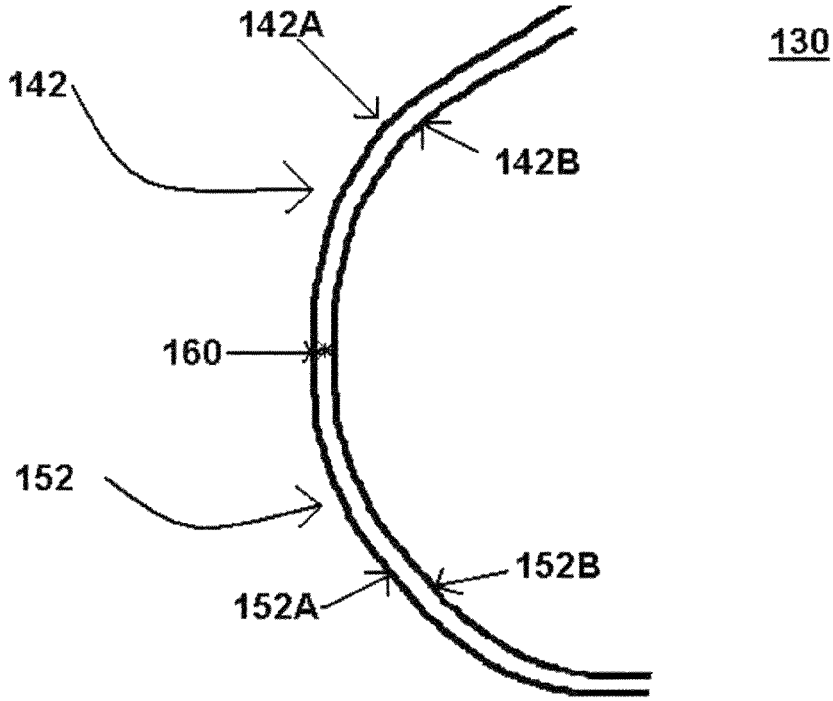
FIG. 4 illustrates a cross-sectional perspective of the breast support garment.

FIG. 2 illustrates a front perspective of the Breast Support Housing 130 (FIGS. 3 and 4 illustrate the Breast Support Housing 130 in detail). In connection with FIGS. 3 and 4, the Breast Support Housing 130 provides two adjacent nested areas or pockets for the breasts of the user. In providing the same, the Breast Support Housing 130 is comprised of a First Upper Contoured Support Panel 140 ("FUCSP"), which includes both a First Exterior Upper Support Panel 140A ("FEUSP") and a First Interior Upper Support Panel 140B ("FIUSP"), a First Lower Contoured Support Panel 150 ("FLCSP"), which includes both a First Exterior Lower Support Panel 150A ("FELSP") and a First Interior Lower Support Panel 150B ("FILSP").

FIG. 4 illustrates the Breast Support Housing 130 wherein the Breast Support Housing 130 further includes a Second Upper Contoured Support Panel 142 ("SUCSP"), which includes both a Second Exterior Upper Support Panel 142A ("SEUSP") and a Second Interior Upper Support Panel 142B ("SIUSP"), and a Second Lower Contoured Support Panel 152 ("SLCSP"), which includes a Second Exterior Lower Support Panel 152A ("SELSP") and a Second Interior Lower Support Panel 152B ("SILSP").

In an embodiment, both the First Exterior Upper Support Panel 140A and the First Interior Upper Support Panel 140B of the First Upper Contoured Support Panel 140 extend to a shoulder region of the user. Further, both the Second Exterior Upper Support Panel 142A and the Second Interior Upper Support Panel 142B of the Second Upper Contoured Support Panel 142 extend to an opposite shoulder region of the user. In an embodiment, in manufacturing a lighter weight garment, Support Panel 130: both First and Second Upper Contoured Support Panels, 140 and 150 and First and Second Lower Contoured Support Panels, 142 and 152, can comprise a single layer of fabric thus eliminating one of the interior or exterior panels.

Figure 8:
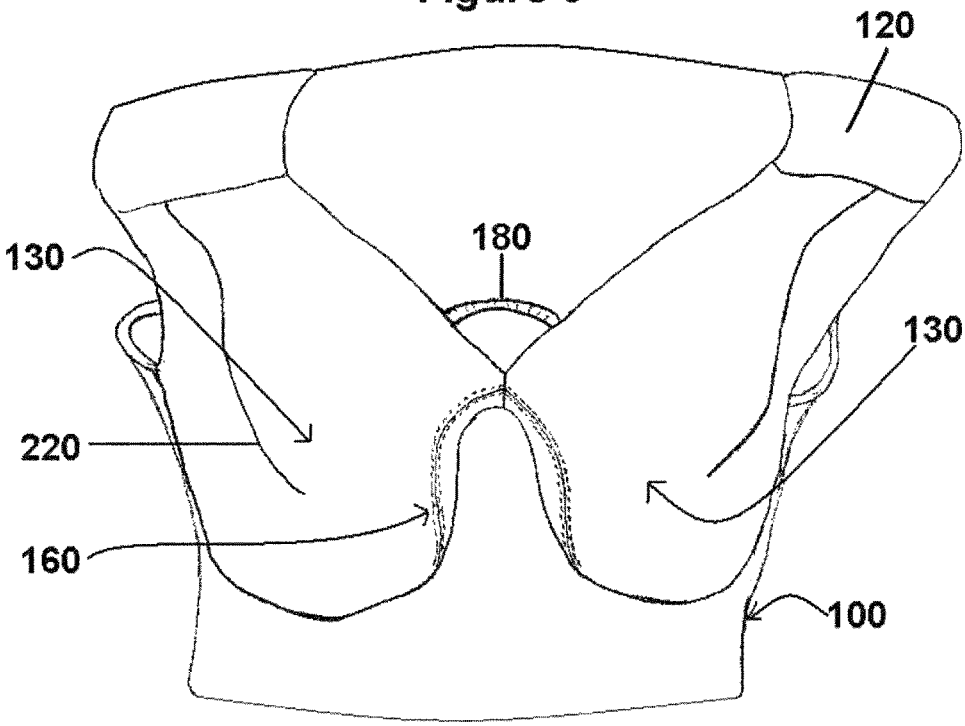
FIG. 8 illustrates a top-down perspective of the breast support garment.

In yet another embodiment, the First Exterior Upper Support Panel 140A and the First Interior Upper Support Panel 140B of the First Upper Contoured Support Panel 140, as well as the Second Exterior Upper Support Panel 142A and the Second Interior Upper Support Panel 142B of the Second Upper Contoured Support Panel 142 can include at least one Contouring Stitching 220 (illustrated in FIG. 8) within any area of the panel. The Contouring Stitching 220 allows for a more contoured design and fit for the user.

Further illustrated in the above-mentioned figures is the Support Attachment 160. The Support Attachment 160 functions to connect the First and Second Exterior Upper Support Panels 140A and 142A with the First and Second Exterior Lower Support Panels 150A and 152A, respectively, as well as the First and Second Interior Upper Support Panels 140B and 142B, and the First and Second Interior Lower Support Panels 150B and 152B, respectively. This structure effectively splits upper from lower panels and forms part of the overall structure necessary for the nested breast support and the necessary contouring to fit to the comfort of the user.

The Support Attachment 160 can include a variety of different sewing stitches such as a double needle stitch, single stitch, lockstitch or any range of equivalents. The stitch chosen is a function of durability as well as comfort to the user. In another embodiment, the Support Attachment 160 is an adhesive, allowing the Breast Support Garment 50 to be seamless. The Support Attachment 160, in yet another embodiment, is a seamless weave.

Figure 5:
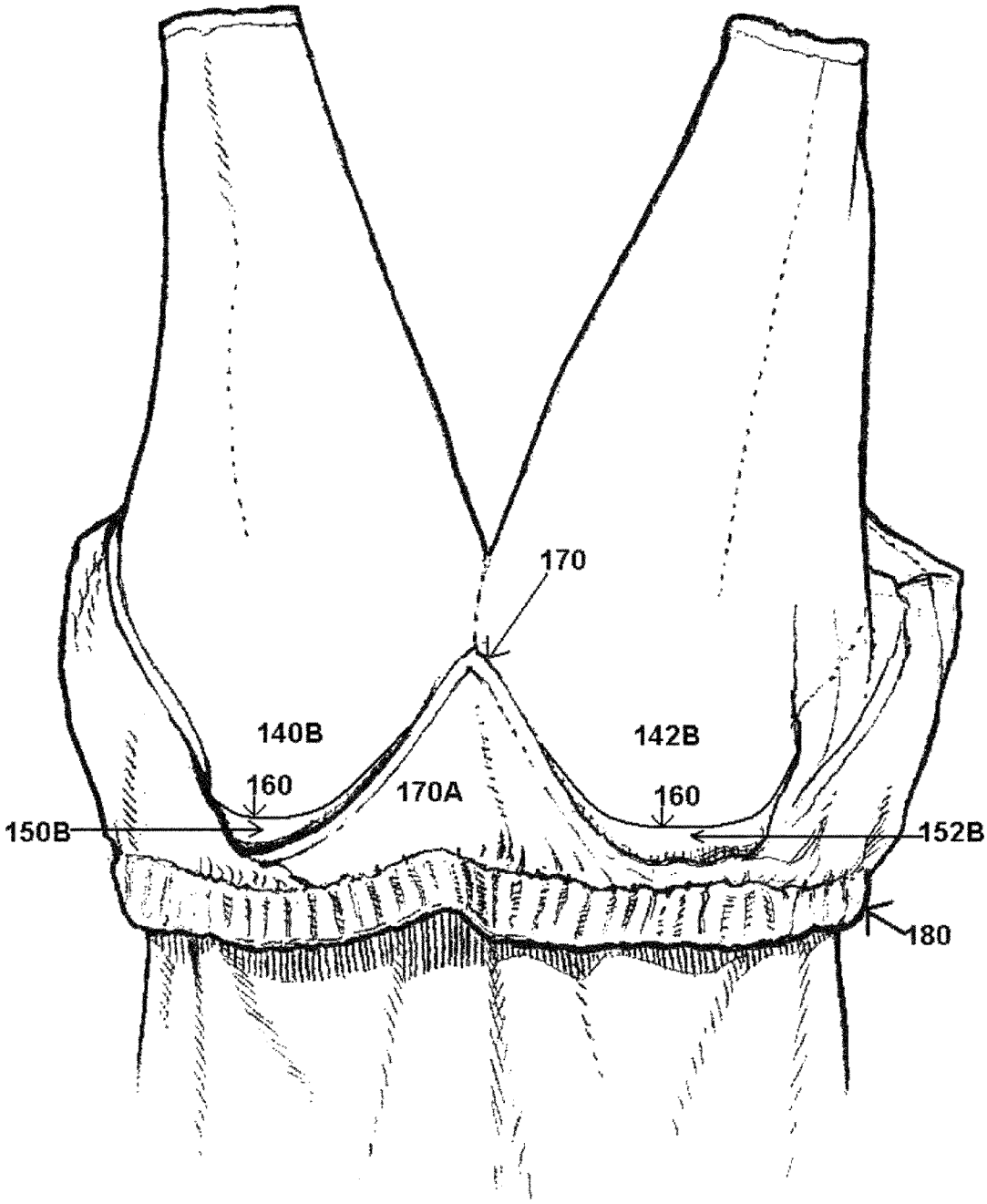
FIG. 5 illustrates an interior rear view perspective of the breast support garment.

FIG. 5 illustrates the Connection Support Attachment 170. FIGS. 1 and 2 also provide perspectives of the Connection Support Attachment 170. The Connection Support Attachment 170 serves to connect the various layers, panels and portions of the Breast Support Garment 50 and serves as the backbone in forming the nested areas or pockets for the breasts of the user. The Connection Support Attachment 170 borders the Top End 110A of the Front Portion Outer Garment Layer 110, joining the Front Portion 110 (illustrated in FIG. 2) and the First Exterior Lower Support Panel 150A, First Interior Lower Support Panel 150B (illustrated in FIG. 3), Second Exterior Lower Support Panel 152A, and Second Interior Lower Support Panel 152B (illustrated in FIG. 4). The provided structure forms the overall structure contoured to the shape of the breast. The contoured pockets will stabilize the breast in its natural state.

In an embodiment, the Connection Support Attachment 170 forms a Triangular Area 170A between the First and Second Upper Contoured Support Panels, 140 and 142, respectively, and the First and Second Lower Contoured Support Panels, 150 and 152, respectively. The function serves to better contour the breasts in their natural state and at the same time provide dimensions that allow for the elimination of rashes and chaffing.

In this particular embodiment, the tip of the Triangular Area 170A serves as a support junction for the attachment of the Internal Support Layer 190 (described below) and the First Exterior Lower Support Panel 150A, First Interior Lower Support Panel 150B, Second Exterior Lower Support Panel 152A, and Second Interior Lower Support Panel 152B. Further, the Support Attachment 160 meets at this junction as well. As such, essentially five pieces of fabric are brought together at this specific junction, which lays flat against the skin for increased comfort and increased pocket strength. Of course, as stated herein in other embodiments, the junction could be met by a seam, stitch, fabric bonding agent, woven seamlessly, or the like, that provides the appropriate strength.

FIG. 5 further illustrates the Internal Support Band 180. The Internal Support Band 180 surrounds the user wearing the Breast Support Garment 50. The Internal Support Band 180 serves to contribute to the comfort of the Breast Support Garment 50 by its elastic nature, fitting the garment snug, but in particular, the Breast Support Housing 130, and around the user's upper torso. This feature allows the Internal Support Band 180 to provide the tension necessary to the contoured pockets, allowing stabilization of the breasts in their natural state. Further advantages of the Internal Support Band 180 are discussed herein.

In an embodiment, the Internal Support Band 180 is partially gathered around the user, meaning the elasticity can be broken up in segments wherein each segment can be attached to another segment by fabric, or an equivalent, rather than elastic surrounded by fabric. In an embodiment, the Internal Support Band 180 is made of elastic gathered or similar material such that it fits to the user. In another embodiment, the Internal Support Band 180 can be fastened and tightened, in that it can be adjustable in nature.

Figure 6:
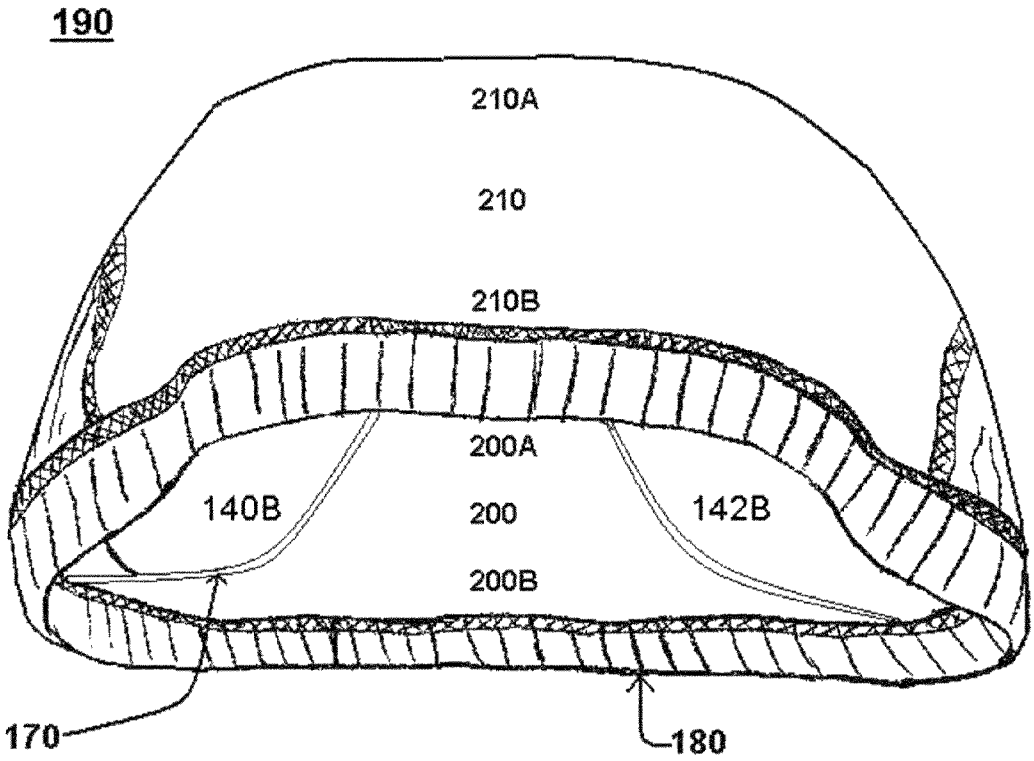
FIG. 6 illustrates an interior upward-view rear perspective the breast support garment.

FIG. 6 illustrates the Internal Support Layer 190. The Internal Support Layer 190 includes a Front Portion Internal Support Layer 200 ("FPISL") and a Rear Portion Internal Support Layer 210 ("RPISL"), both having a Top and Bottom End 200A and 210A, and 200B and 210B, respectively. The Internal Support Layer 190, in an embodiment, can be a single layer, and is connected to the Internal Support Band 180 at the Bottom End 200B and 210B. The Top End 200A of the Front Portion Internal Support Layer 200 is connected to the Connection Support Attachment 170.

Figure 7:
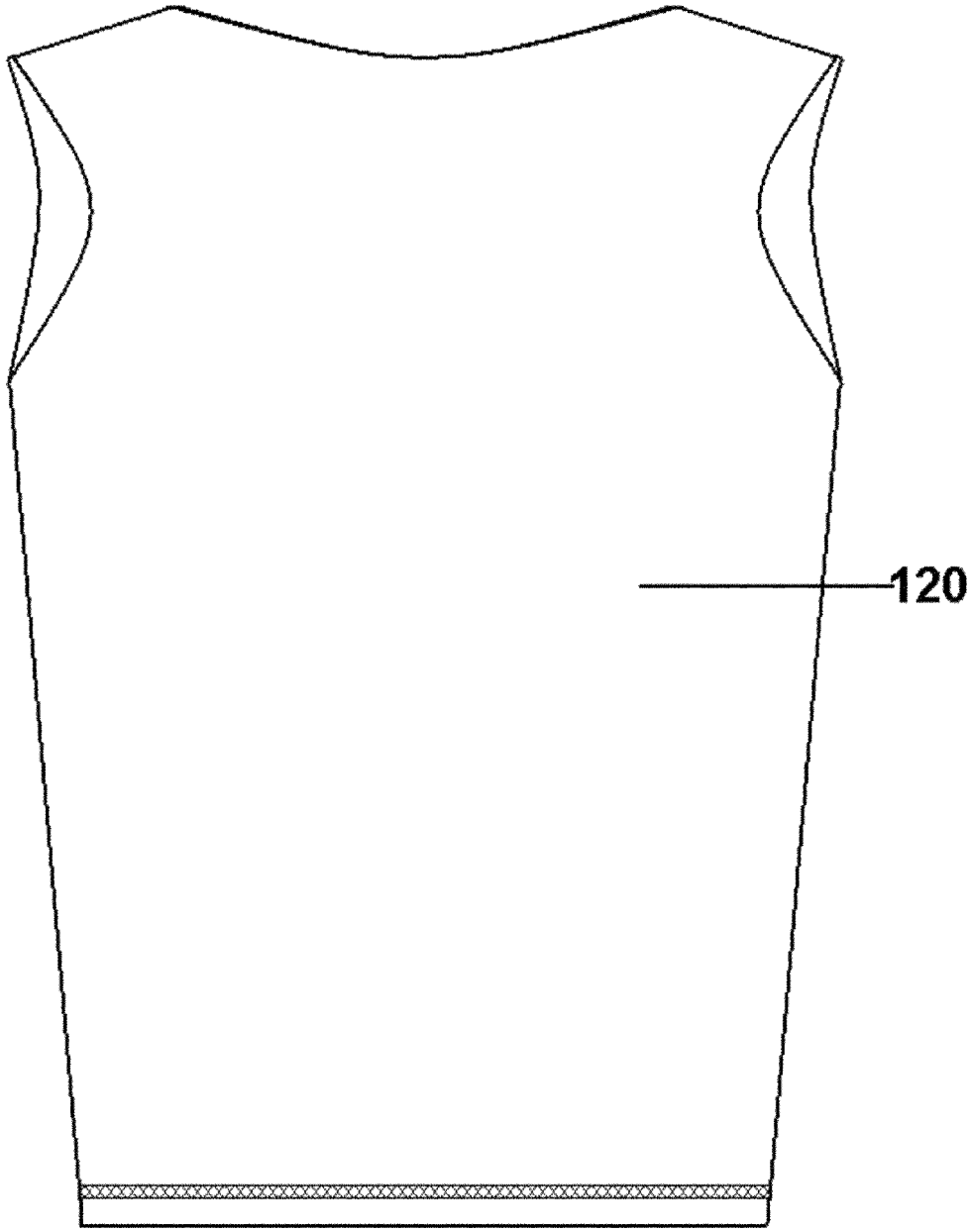
FIG. 7 illustrates an exterior back perspective of the breast support garment.

The Rear Portion Internal Support Layer 210, as stated above, is connected the ISB 180 at the Bottom End 210B, however, the Rear Portion Internal Support Layer 210 runs together with and inside to the Rear Portion Outer Garment Layer 120 (illustrated in FIG. 7), which together, are present on the back part of the user's torso.

The Rear Portion Outer Garment Layer 120 extends over the user's shoulders and connects with the Breast Support Housing 130. This feature is illustrated in FIGS. 1 and 2, and specifically in FIG. 8. In an embodiment, the connection between the two structures is by thread. In another embodiment, the connection is by adhesive. In another embodiment, the Breast Support Housing 130 and the Outer Garment Layer 120 are seamless and only defined by regions on either side of the user's shoulders.

Figure 9:
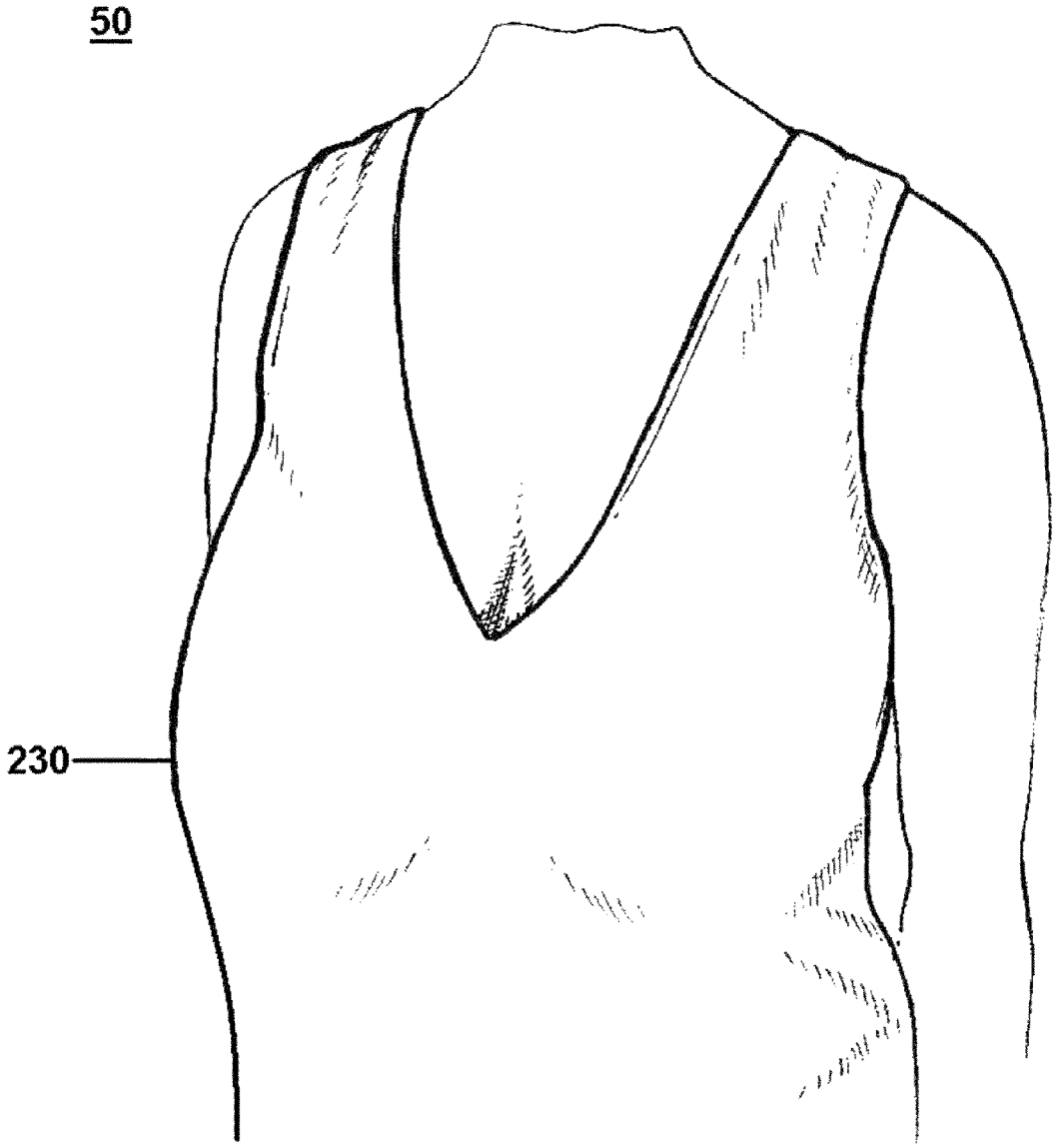
FIG. 9 illustrates a front perspective of an embodiment of the breast support garment.

FIG. 9 illustrates an embodiment of the Breast Support Garment 50. In this embodiment, an Outer Cover 230 is provided. This embodiment provides the increased ability for the Breast Support Garment 50 to be worn outside or become outwear. The Outer Cover 230 is provided as a way to protect the user from any potential visible features or essentially provides added security to the user.

The Breast Support Garment provides bra-free comfort. Many products are made to have lift or support features, which many users do not desire. In going bra-free, problems do arise. Some of these problems are swinging and swaying of the breasts when in motion, excess moisture buildup between the underside of the breasts and the ribcage/abdomen, chafing, and rashes, and/or irritation on the underside of the breasts. Not to mention the fact that in going bra-free, the users reveal to the world that they are not wearing a bra. This situation can be embarrassing.

The Breast Support Garment provides comfort to women. The Breast Support Garment holds the breasts in their natural and relaxed state inside contoured nest-like pockets. Each breast has a separate pocket that is basically comprised of the Breast Support Housing, Connection Support Attachment, the Internal Support Band, and the Internal Support Layer. It is the combination of the above structures that prevent the swinging and swaying during motion. This is particularly relevant to those women who have ptosis (sagging) of the breasts because their breasts can be held in place comfortably, without worrying about breast swing and sway. However, the feature also improves the fit, allowing users of different sizes to be able to fit in the nest-like pockets.

Another advantage of the nest-like pockets is that the structure covers the underside of the breasts, preventing skin-to-skin contact on the underside of the breasts with the ribcage/abdomen. One way the Breast Support Garment accomplishes this is by the structure of the Internal Support Band, the Internal Support Layer and the Breast Support Housing.

The Internal Support Band, in an embodiment, goes all the way around the torso of the user and allows the attached Internal Support Layer and the Breast Support Housing to serve as a barrier. Further, the Internal Support Band also helps reduce moisture buildup from sweating, chafing, rashes, and other forms of discomfort on the underside of the breasts that are experienced when going bra-free.

An additional advantage of having a top that holds the breasts in their natural and relaxed state is that it helps improve circulation within the breasts as well as unrestricted flow of the lymphatic system, which may help prevent various breast diseases. See, e.g., Singer and Grismaijer, *Dressed to Kill: The Link Between Breast Cancer and Bras* (Avery 1995). Ultimately, the use of the garment will result in healthier breasts.

Another advantage of the invention is a function of the structure of the Connection Support Attachment. The Connection Support Attachment is provided such that a Triangle Area is formed between the breasts of the user. This area separates the breasts and prevents the breasts from contacting each other, but also assists in holding the breasts in the pockets. Thus, the Connection Support Attachment secures fit without being restrictive and improves the ability to hold the breasts in place.

A further advantage of the invention is that it can be worn under any other garment like a t-shirt, dress, blouse or camisole, as sleepwear, or in an embodiment it can be worn on its own with an Outer Cover over the Breast Support Housing, without revealing to anyone that they are not wearing a bra. This is possible because of the Outer Garment Layer and the Breast Support Housing function to act as regular outerwear and prevent the potentially embarrassing situation of going bra-free. This is specifically because the layers of the Breast Support Housing, namely, the First and Second Upper Contoured Support Panels and First and Second Lower Contoured Support Panels comprise both an exterior and interior panel.

As stated herein, the foregoing is considered as illustrative only of the invention and is not to be interpreted in the limiting sense. Since numerous modifications and changes will readily occur to those skilled in the art, the invention is not limited to the exact description, and accordingly, all suitable modifications and equivalents from technological improvements including, but not limited to seamless construction, falling within the scope of the invention are incorporated herein.

What is claimed:

1. A breast support garment including an outer garment structure in combination with an internal breast support structure, the breast garment comprising:

an outer garment layer including a front portion outer garment layer and a rear portion outer garment layer having a top and bottom end, respectively;

a breast support housing including adjacent first and second upper contoured support panels and first and second lower contoured support panels, the panels having exterior and interior support panels, wherein the exterior and interior support panels of the first and second upper contoured support panels extend to a shoulder region of a user;

a support attachment, the support attachment connecting both first and second exterior upper and lower support panels and connecting a first and second interior upper and lower support panels;

a connection support attachment, the connection support attachment connecting the top end of the front portion outer garment layer and the first and second exterior and interior first and second lower contoured support panels of the breast support housing;

an internal support layer, the internal support layer interior to the outer garment layer and the breast support housing having a front portion internal support layer and a rear portion internal support layer, the portions having a top and bottom end;

an internal support band, the internal support band interior the outer garment layer and the breast support housing, connected to the internal support layer at the bottom end of the front and rear portion internal support layers, the top end of the front portion internal support layer connected to the connection support attachment, the top end of the rear portion internal support member and the rear portion of the outer garment layer extending to the shoulder region of the user.

2. The breast support garment of claim 1 wherein the outer garment is comprised of a fabric.

3. The breast support garment of claim 1 wherein the bottom end of the outer garment layer extends to the waist of the user.

4. The breast support garment of claim 1 wherein the breast support housing is a stretchable fabric.

5. The natural support garment of claim 1 wherein the breast support housing includes contouring stitching.

6. The breast support garment of claim 1 wherein the support attachment is an adhesive.

7. The breast support garment of claim 1 wherein the support attachment is a seamless weave.

8. The breast support garment of claim 5 wherein the connection support attachment is an adhesive.

9. The breast support garment of claim 5 wherein the connection support attachment is a seamless weave.

10. The breast support garment of claim 1 wherein the internal support layer is comprised of at least one layer of fabric.

11. The breast support garment of claim 1 wherein internal support band is elastic.

12. The breast support garment of claim 1 wherein internal support band is a seamless weave.

13. The breast support garment of claim 1 wherein the internal support band is adjustable.

14. The breast support garment of claim 1 wherein the internal support band is partially elastic.

15. The breast support garment of claim 1 wherein the internal support band is partially a seamless weave.

* * * * *